US008490296B2

(12) United States Patent
Hurd et al.

(10) Patent No.: US 8,490,296 B2
(45) **Date of Patent: *Jul. 23, 2013**

(54) ARTICLE OF FOOTWEAR WITH FOREFOOT PLATES

(75) Inventors: John Hurd, Tigard, OR (US); Christopher S. Cook, Portland, OR (US); Steven F. Smith, Lake Oswego, OR (US); Jeffrey L. Johnson, Busan (KR); Paul VanDomelen, Busan (KR); Kevin W. Hoffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/413,800

(22) Filed: Mar. 7, 2012

(65) Prior Publication Data

US 2012/0159812 A1 Jun. 28, 2012

Related U.S. Application Data

(63) Continuation of application No. 11/972,652, filed on Jan. 11, 2008, now Pat. No. 8,151,485.

(51) Int. Cl.
*A43B 13/28* (2006.01)

(52) U.S. Cl.
USPC ..... 36/27; 36/25 R; 36/103

(58) Field of Classification Search
USPC ..... 36/27, 25 R, 103, 7.8, 28, 38
See application file for complete search history.

(56) References Cited

U.S. PATENT DOCUMENTS

| | | | |
|---|---|---|---|
| 337,146 | A | 3/1886 | Gluecksmann |
| 898,084 | A | 9/1908 | Backermann |
| 1,690,837 | A | 11/1928 | Rehleé |
| 1,736,609 | A | 11/1929 | Letourneau |
| 3,550,597 | A | 12/1970 | Coplans |
| 3,738,373 | A | 6/1973 | Glancy |
| 5,337,492 | A | 8/1994 | Anderié et al. |
| 5,678,327 | A | 10/1997 | Halberstadt |
| 6,550,160 | B2 | 4/2003 | Miller, II |
| 6,886,274 | B2 | 5/2005 | Krafsur et al. |
| 6,948,262 | B2 | 9/2005 | Kerrigan |
| 7,100,308 | B2 | 9/2006 | Aveni |
| 7,418,790 | B2 | 9/2008 | Kerrigan |
| 7,421,805 | B2 | 9/2008 | Geer |
| 7,574,817 | B2 | 8/2009 | Fechter |
| 2003/0208929 | A1 | 11/2003 | Lucas et al. |
| 2003/0226283 | A1 | 12/2003 | Braunschweiler |
| 2005/0108897 | A1 | 5/2005 | Aveni |
| 2005/0246922 | A1 | 11/2005 | Gibert et al. |
| 2010/0140854 | A1 | 6/2010 | Aveni et al. |
| 2011/0005100 | A1 | 1/2011 | Smaldone et al. |

FOREIGN PATENT DOCUMENTS

| | | | |
|---|---|---|---|
| EP | 1839511 | A | 10/2007 |
| EP | 1844673 | A | 10/2007 |

OTHER PUBLICATIONS

Chinese Office Action issued Feb. 23, 2012, in corresponding Chinese Patent Application No. 200880124431.1.

International Search Report and Written Opinion issued Jun. 9, 2009 in connection with corresponding PCT Application No. PCT/US2008/085291.

*Primary Examiner* — Ted Kavanaugh
(74) *Attorney, Agent, or Firm* — Banner & Witcoff, Ltd.

(57) ABSTRACT

An article of footwear includes an upper and a sole assembly secured to the upper. The sole assembly has an upper plate and a lower plate in a forefoot portion of the sole assembly, and a plurality of lower plate arms curving downwardly from the upper plate.

14 Claims, 6 Drawing Sheets

ARTICLE OF FOOTWEAR WITH FOREFOOT PLATES

RELATED APPLICATIONS

This application is a continuation of application Ser. No. 11/972,652 now U.S. Pat. No. 8,151,485, filed on Jan. 11, 2008, which is entirely incorporated herein by reference.

FIELD OF THE INVENTION

This invention relates generally to an article of footwear, and, in particular, to an article of footwear with forefoot plates.

BACKGROUND OF THE INVENTION

Conventional articles of athletic footwear include two primary elements, an upper and a sole structure. The upper provides a covering for the foot that comfortably receives and securely positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces, the sole structure may provide traction, control foot motions (e.g., by resisting over pronation), and impart stability, for example. Accordingly, the upper and the sole structure operate cooperatively to provide a comfortable structure that is suited for a wide variety of activities, such as walking and running.

The sole structure generally incorporates multiple layers that are conventionally referred to as an insole, a midsole, and an outsole. The insole is a thin, compressible member located within the upper and adjacent to a plantar (i.e., lower) surface of the foot to enhance footwear comfort. The midsole, which is conventionally secured to the upper along the length of the upper, forms a middle layer of the sole structure and is primarily responsible for attenuating ground reaction forces. The outsole forms the ground-contacting element of footwear and is usually fashioned from a durable, wear-resistant material that includes texturing to improve traction.

The conventional midsole is primarily formed from a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the activity for which the footwear is intended to be used. In addition to polymer foam materials, conventional midsoles may include, for example, one or more fluid-filled bladders and moderators.

It would be desirable to provide an article of footwear that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear with forefoot plates. In accordance with a first aspect, an article of footwear includes an upper and a sole assembly secured to the upper. The sole assembly has an upper plate and a lower plate in a forefoot portion of the sole assembly, and a plurality of lower plate arms curving downwardly from the upper plate.

In accordance with another aspect, an article of footwear includes an upper and a sole assembly secured to the upper. The sole assembly includes an upper plate and a lower plate having a plurality of lower plate arms curving downwardly from a lateral side of a forefoot portion of the upper plate and a plurality of lower plate arms curving downwardly and outwardly from a medial side of a forefoot portion of the upper plate.

In accordance with a further aspect, an article of footwear includes an upper and a midsole secured to a lower surface of the upper, with a lower surface of the midsole secured to an upper surface of the upper plate. A sole assembly is secured to a lower surface of the midsole and includes an upper plate and a lower plate of unitary construction with the upper plate. The lower plate has a plurality of lateral lower plate arms curving downwardly from a lateral side of a forefoot portion of the upper plate and a plurality of medial lower plate arms curving downwardly from a medial side of a forefoot portion of the upper plate. Each of a plurality of outsole portions is secured to a lower surface of a corresponding lower plate arm.

Substantial advantage is achieved by providing footwear with forefoot plates. In particular, certain embodiments provides a spring-like action in lower plate arms of the footwear, which are pre-flexed in a curved condition, thereby helping a user change direction and cut when using footwear, thereby improving propulsion for the user. The lower plate arms are curved to help relieve stress encountered during use of the footwear.

These and additional features and advantages disclosed here will be further understood from the following detailed disclosure of certain embodiments.

Figure 1:
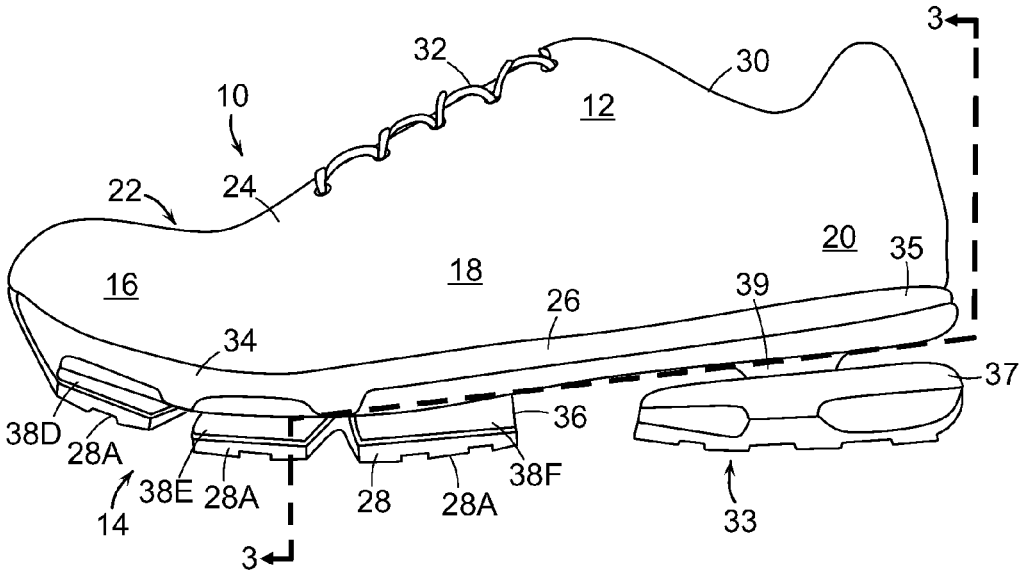
FIG. 1 is an elevation view of an article of footwear with a forefoot plate.

The figures referred to above are not drawn necessarily to scale and should be understood to provide a representation of the invention, illustrative of the principles involved. Some features of the article of footwear with a forefoot plate depicted in the drawings have been enlarged or distorted relative to others to facilitate explanation and understanding. The same reference numbers are used in the drawings for similar or identical components and features shown in various alternative embodiments. Articles of footwear with a forefoot plate as disclosed herein would have configurations and components determined, in part, by the intended application and environment in which they are used.

DETAILED DESCRIPTION OF CERTAIN PREFERRED EMBODIMENTS

The following discussion and accompanying figures disclose various embodiments of a sole structure for an article of footwear. Concepts related to the sole structure are disclosed with reference to footwear having a configuration that is suitable for athletic activities, e.g., the sport of basketball. However, the sole structure may be applied to a wide range of athletic footwear styles, including tennis shoes, football shoes, cross-training shoes, walking shoes, soccer shoes, and hiking boots, for example. The sole structure may also be applied to footwear styles that are generally considered to be non-athletic, including dress shoes, loafers, sandals, and work boots. An individual skilled in the relevant art will appreciate, therefore, that the concepts disclosed herein apply to a wide variety of footwear styles, in addition to the specific style discussed in the following material and depicted in the accompanying figures.

Figure 2:
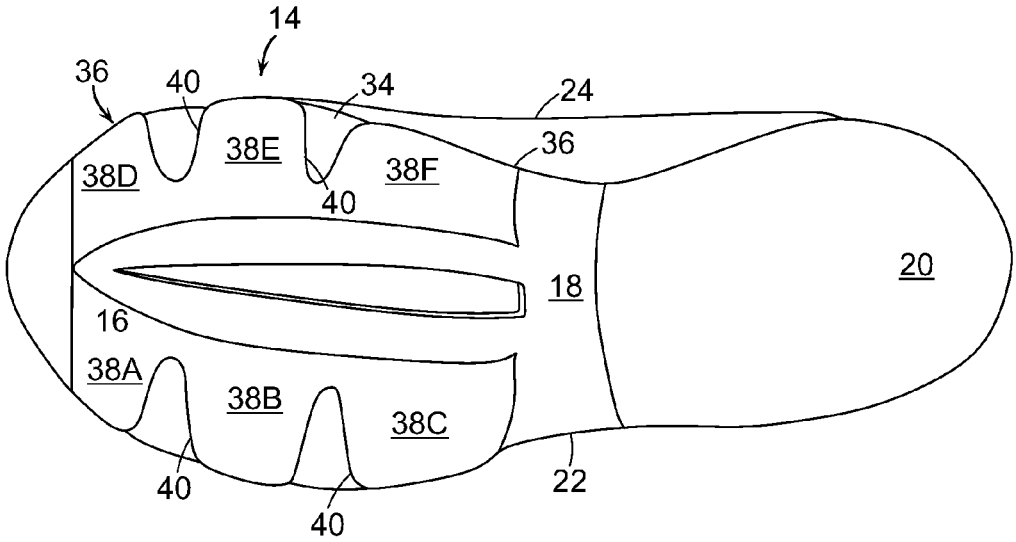
FIG. 2 is a bottom plan view of the article of footwear of FIG. 1, shown without an outsole.

An article of footwear 10 is depicted in FIGS. 1 and 2 as including an upper 12 and a sole assembly 14. For reference purposes, footwear 10 may be divided into three general portions: a forefoot portion 16, a midfoot portion 18, and a heel portion 20, as shown in FIGS. 1 and 2. Footwear 10 also includes a lateral side 22 and a medial side 24. Forefoot portion 16 generally includes portions of footwear 10 corresponding with the toes and the joints connecting the metatarsals with the phalanges. Midfoot portion 18 generally includes portions of footwear 10 corresponding with the arch area of the foot, and heel portion 20 corresponds with rear portions of the foot, including the calcaneus bone. Lateral side 22 and medial side 24 extend through each of portions 16-20 and correspond with opposite sides of footwear 10. Portions 16-20 and sides 22-24 are not intended to demarcate precise areas of footwear 10. Rather, portions 16-20 and sides 22-24 are intended to represent general areas of footwear 10 to aid in the following discussion. In addition to footwear 10, portions 16-20 and sides 22-24 may also be applied to upper 12, sole assembly 14, and individual elements thereof.

The figures illustrate only the article of footwear intended for use on the right foot of a wearer. One skilled in the art will recognize that a left article of footwear, such article being the mirror image of the right, is intended to fall within the scope of the present invention.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the right as seen in FIG. 1. Naturally, forwardly is toward forefoot portion 16, that is, to the left as seen in FIG. 1, and downwardly is toward the bottom of the page as seen in FIG. 1. Inwardly is toward the center of footwear 10, and outwardly is toward the outer peripheral edge of footwear 10.

Upper 12 forms an interior void that comfortably receives a foot and secures the position of the foot relative to sole assembly 14. The configuration of upper 12, as depicted, is suitable for use during athletic activities that involve running. Accordingly, upper 12 may have a lightweight, breathable construction that includes multiple layers of leather, textile, polymer, and foam elements adhesively bonded and stitched together. For example, upper 12 may have an exterior that includes leather elements and textile elements for resisting abrasion and providing breathability, respectively. The interior of upper 12 may have foam elements for enhancing the comfort of footwear 10, and the interior surface may include a moisture-wicking textile for removing excess moisture from the area immediately surrounding the foot.

Sole assembly 14 may be secured to upper 12 by an adhesive, or any other suitable fastening means. Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 includes an insole (not shown) located within upper 12, a midsole 26, and an outsole 28. Midsole 26 is attached to upper 12 and functions as the primary shock-attenuating and energy-absorbing component of footwear 10. Outsole 28 is attached to the lower surface of midsole 26 by adhesive or other suitable means. Suitable materials for outsole 28 include traditional rubber materials. Other suitable materials for outsole 28 will become readily apparent to those skilled in the art, given the benefit of this disclosure. In certain embodiments, sole assembly 14 may not include an outsole layer separate from midsole 26 but, rather, the outsole may comprise a bottom surface of midsole 26 that provides the external traction surface of sole assembly 14.

Upper 12 is depicted as having a substantially conventional configuration that incorporates a plurality material elements (e.g., textiles, foam, leather, and synthetic leather) stitched or adhesively bonded together to form an interior void for securely and comfortably receiving a foot. The material elements may be selected and located with respect to upper 12 in order to selectively impart properties of durability, air-permeability, wear-resistance, flexibility, and comfort, for example. The material elements form a structure that defines an interior void for receiving the foot. An ankle opening 30 in heel portion 20 provides access to the interior void. In addition, upper 12 may include a lace 32 that is utilized in a conventional manner to modify the dimensions of the interior void, thereby securing the foot within the interior void and facilitating entry and removal of the foot from the interior void. Lace 32 may extend through apertures in upper 12, and a tongue portion of upper 12 may extend between the interior void and lace 32. Given that various aspects of the present application primarily relate to sole assembly 14, upper 12 may exhibit the general configuration discussed above or the general configuration of practically any other conventional or non-conventional upper. Accordingly, the structure of upper 12 may vary significantly within the scope of the present invention.

Sole assembly 14 includes an upper plate 34 secured to a lower surface of midsole 26. A lower plate 36 includes a plurality of lower plate arms 38 that curve downwardly from upper plate 34. In the illustrated embodiment, lower plate arms 38 curve downwardly and outwardly from upper plate 34 such that they are substantially concave with respect to upper plate 34.

Each lower plate arm 38 is spaced from adjacent lower plate arm 38 by a slot 40 formed in lower plate 36. Lower plate 36 is seen in FIG. 2 with outsole 28 not shown for clarity purposes.

In certain embodiments lower plate 36 includes a first lateral lower plate arm 38A positioned in a front portion of forefoot portion 16 of sole assembly 14. A second lateral lower plate arm 38B is positioned in a central portion of forefoot portion 16 of sole assembly 14. A third lateral lower plate arm 38C is positioned in a rear portion of forefoot portion 16 of sole assembly 14.

Similarly, lower plate 36 includes a first medial lower plate arm 38D positioned in a front portion of forefoot portion 16 of sole assembly 14. A second medial lower plate arm 38E is positioned in a central portion of forefoot portion 16 of sole assembly 14. A third medial lower plate arm 38F is positioned in a rear portion of forefoot portion 16 of sole assembly 14.

In certain embodiments, lower plate 36 and upper plate 34 are of unitary, that is, one-piece, construction. Upper plate 34 and lower plate members 36 may be formed of any number of materials including glass-filled nylon, carbon-filled materials, polyamides such as Aramid, produced by Dupont, and a poly-paraphenylene terephthalamides such as Kevlar®, produced by Dupont, a polyether block copolyamide (sold as Pebax® by ATOFINA Chemicals of Philadelphia, Pa.), a blend of a polyether block copolyamide with another material (such as glass-filled nylon, carbon-filled materials, polyamides, or poly-paraphenylene terephthalamides), thermoplastic polyurethane (TPU), or other materials. Such materials are advantageously cut resistant and provide good dimensional stability for sole assembly 14.

Outsole 28 may be formed of a plurality of outsole portions 28A, each of which is secured to a lower surface of a corresponding lower plate arm 36A-F, as seen in FIG. 1.

In the illustrated embodiment, heel portion 20 of sole assembly 14 includes a pivot element 33 including an upper support 35 connected to a lower support 37 by way of a coupling 39. Coupling 39 allows upper support 35 to pivot with respect to lower support 37. It is to be appreciated that heel portion 20 may have a more conventional configuration in other embodiments.

Figure 4:
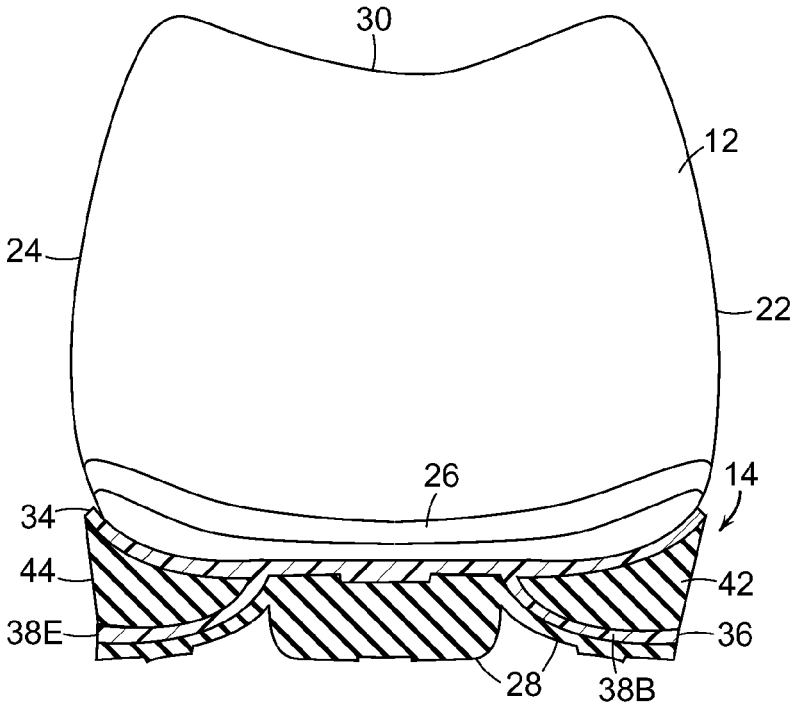
FIG. 4 is a partial section view of an alternative embodiment of the article of footwear of FIG. 1.
Figure 5:
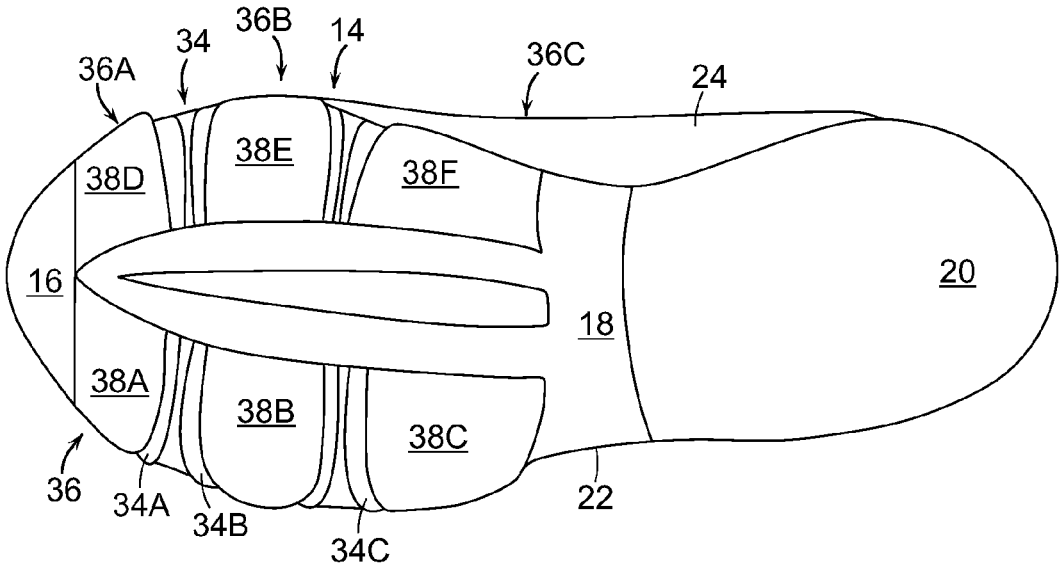
FIG. 5 is a bottom plan view of another alternative embodiment of the article of footwear of FIG. 1, shown without an outsole.

Another embodiment of footwear 10 is shown in FIG. 4, in which a first lateral insert 42 is provided between upper plate 34 and first, second, and third medial lower plate arms 38D, E, F. Similarly a second medial insert 44 is provided between upper plate 34 and first, second, and third lateral lower plate arms 38A, B, C. Lateral insert 42 and medial insert 44 may be formed of an air bladder, an elastomer, or a foam material, for example, and serve to provide additional support and cushioning for sole assembly 14.

Another embodiment of footwear 10 is shown in FIG. 4, in which upper plate 34 is formed of a first front portion 34A positioned in a front portion of forefoot portion 16 of sole assembly 14, a second central portion 34B spaced slightly rearwardly from front portion 34A and positioned in a central portion of forefoot portion 16 of sole assembly 14, and a third rear portion 34C spaced slightly rearwardly from middle portion 34B and positioned in a rear portion of forefoot portion 16 of sole assembly 14. Lateral lower plate arms 38A, 38B, and 38C extend from front portion 34A, central portion 34B, and rear portion 34C, respectively, of upper plate 34. Medial lower plate arms 38D, 38E, and 38F extend from front portion 34A, central portion 34B, and rear portion 34C, respectively, of upper plate 34. In such an embodiment, with upper plate 34 formed of three separate and distinct portions, with accompanying lower plate arms, forefoot portion 16 of footwear 10 can more easily bend and flex, thereby enhancing comfort and flexibility of footwear 10.

Figure 3:
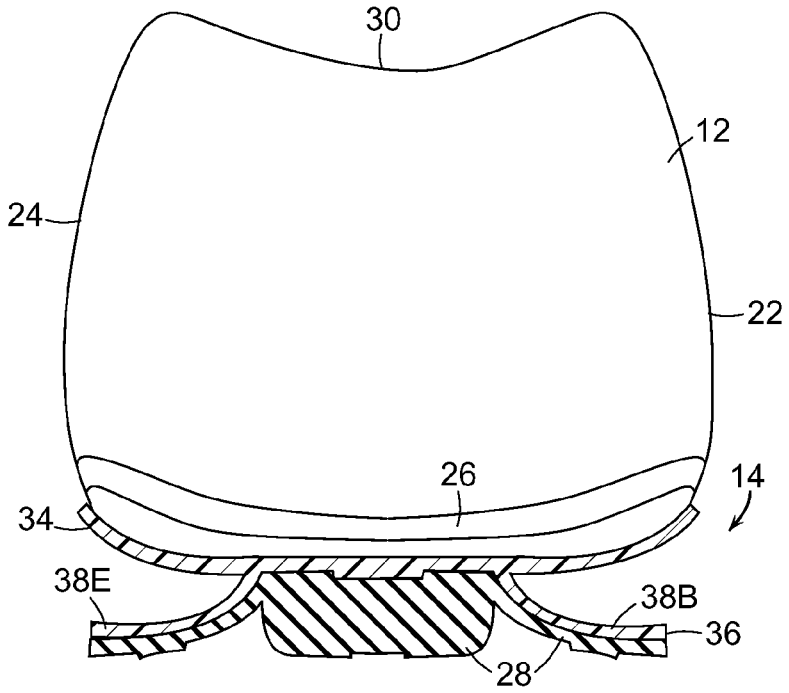
FIG. 3 is a partial section view of the article of footwear of FIG. 1, taken along line 3-3 of FIG. 1.
Figure 6:
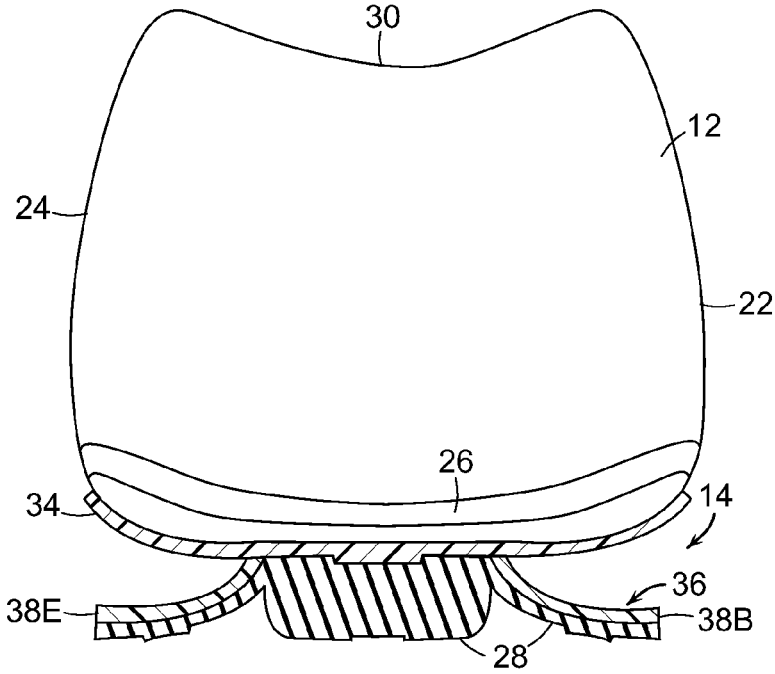
FIG. 6 is a partial section view of an alternative embodiment of the article of footwear of FIG. 1.

In certain embodiments, as seen in FIG. 3, upper plate 34 and lower plate arms 38A-E are of unitary construction. It other embodiments, as seen in FIG. 6, upper plate and lower plate arms 38A-E may be separate elements secured to one another with adhesive or other suitable fastening means.

Figure 7:
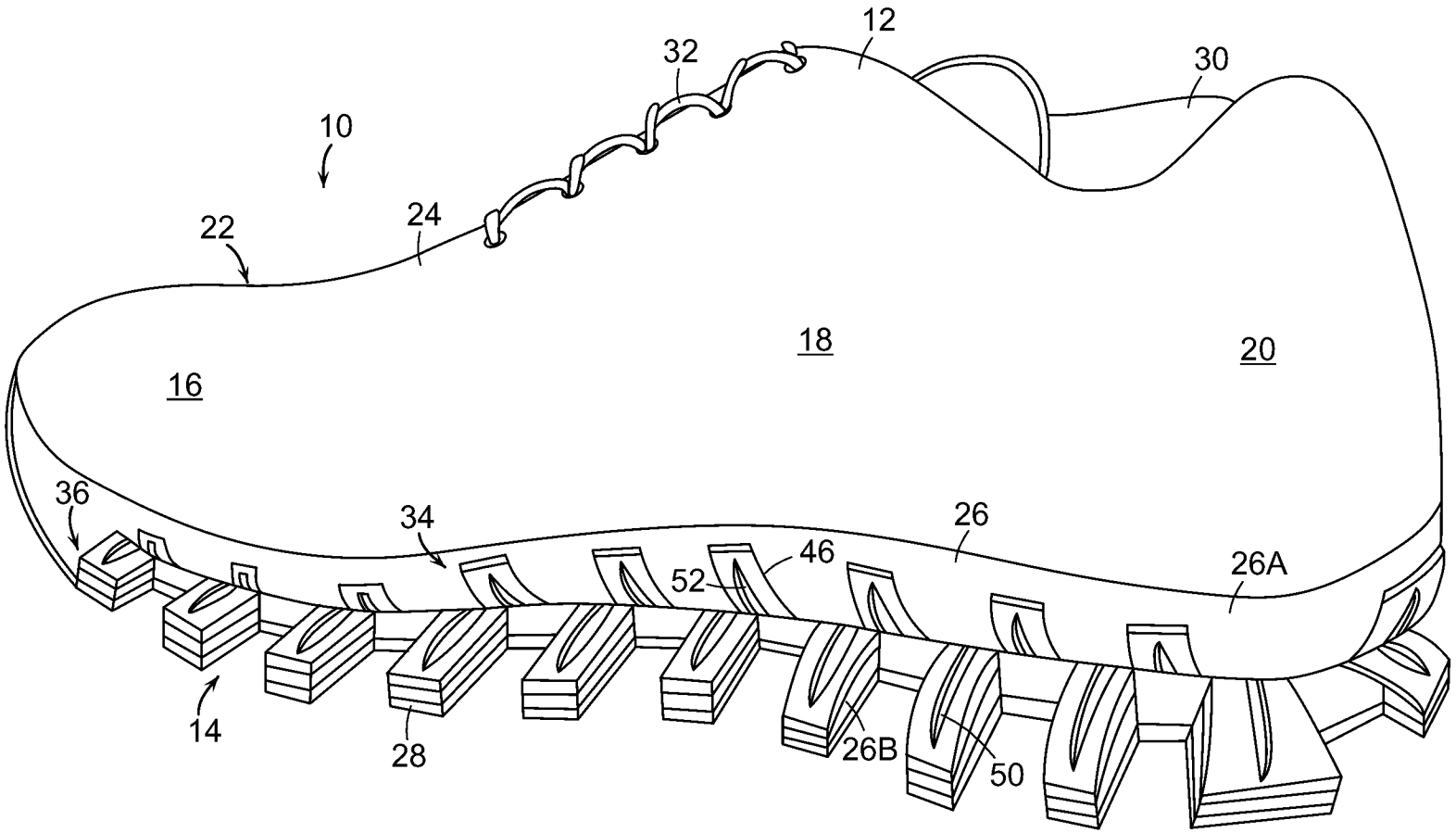
FIG. 7 is a perspective view of a further alternative embodiment of the article of footwear of FIG. 1.

Another embodiment is shown in FIG. 7. In this embodiment, upper plate 34 includes a plurality of upper plate arms 46 and lower plate 36 includes a plurality of lower plate arms 48. In this embodiment, lower plate arms 48 curve outwardly and downwardly from upper plate 34 such that lower plate arms 48 are substantially convex with respect to upper plate 34. Upper plate arms 46 and lower plate arms 48 are staggered, or offset, with respect to one another such that no upper plate arm 46 is positioned above a lower plate arm 48 and vice versa.

In the illustrated embodiment, midsole 26 includes a first portion 26A positioned above upper plate 34 and a second portion 26B positioned below lower plate arms 48. It can be seen that in this embodiment, second portion 26B has been cut away between adjacent lower plate arms 48. Additionally, in this embodiment, upper plate arms 46 and lower plate arms 48 extend along substantially the entire length of sole assembly 14. It is to be appreciated that upper plate arms 46 and lower plate arms 48 can be positioned at any location along sole assembly 14.

It is to be appreciated that the upper and lower plate arms can be modified to optimize performance and comfort. The material, thickness, degree of curvature, length or any other aspects of the geometry of the arms can be altered to affect their performance. For example, in certain embodiments, as seen in FIG. 7, a first rib 50 extends along an upper surface of each lower plate arm 48 and a second rib 52 extends along a lower surface of each upper plate arm 46. It is to be appreciated that in certain embodiments, a first rib 50 may be provided on one or more but not all of lower plate arms 48, and that a second rib 52 may be provided on one or more but not all of upper plate arms 46.

Figure 9:
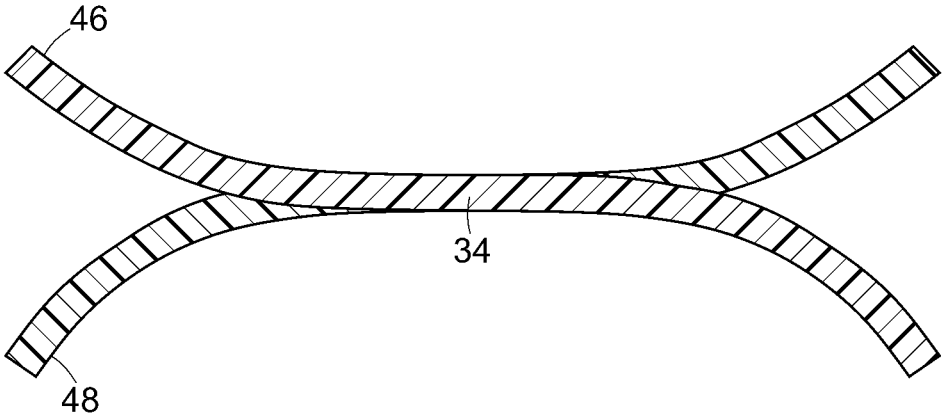
FIG. 9 is a section view of an embodiment of the plate assembly of the article of footwear of FIG. 7.

It is to be appreciated that the embodiment illustrated in FIG. 7 may be constructed such that upper plate 34 is common to both upper plate arms 46 and lower plate arms 48, as seen in FIG. 9. In such an embodiment, upper plate 34 could alternatively be referred to simply as a plate, and upper plate arms 46 and lower plate arms 48 could alternatively be referred to as upper arms and lower arms, respectively. As can be seen FIGS. 7 & 9, the upper and lower arms 46, 48 alternately curve upwardly and downwardly from the plate, in butterfly fashion.

Figure 8:
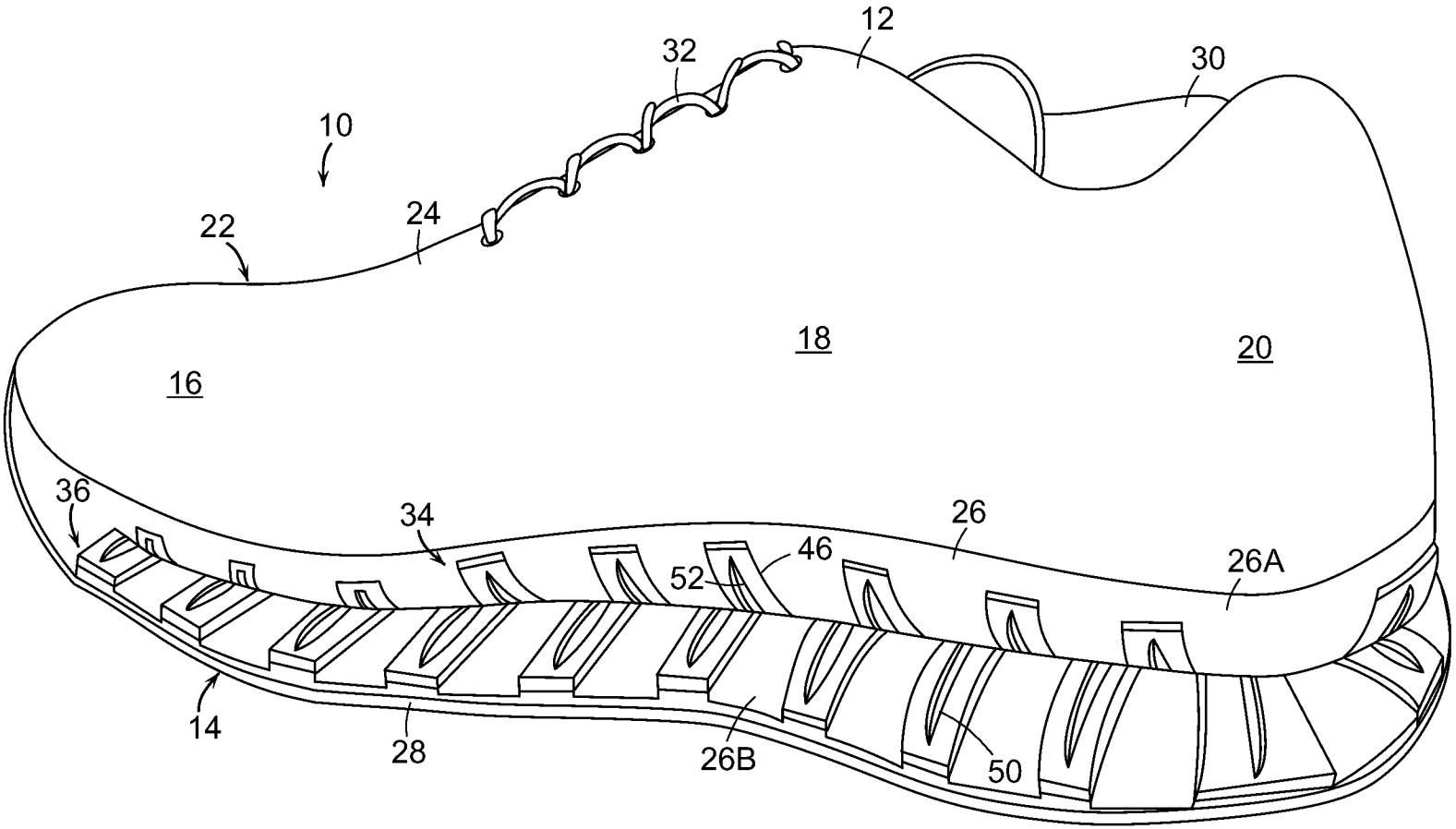
FIG. 8 is a perspective view of yet a further alternative embodiment of the article of footwear of FIG. 1.

Another embodiment is shown in FIG. 8, which is similar to the embodiment shown in FIG. 7, with one exception. In the embodiment of FIG. 8, lower portion 26B of midsole 26B is not cut away between adjacent lower plate arms 48, but, rather, is a contiguous midsole along the length of sole assembly 14.

The spring-like action of the arms of sole assembly 14, which are pre-flexed in a curved condition, helps a user change direction and cut when using footwear 10, thereby improving propulsion for the user. The curvature of the arms helps to relieve stress encountered during use of footwear 10. The arms of sole assembly 14 provide independent suspension for running on uneven surfaces, and provide a more stable ride for the foot as the independent elements adapt to the uneven terrain.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

an upper;

a sole assembly secured to the upper and comprising:

an upper plate having a medial side curving upwardly along a portion of the upper and a lateral side curving upwardly along a portion of the upper; and a lower plate in a forefoot portion of the sole assembly and having a plurality of lower plate arms, each lower plate arm curving downwardly from the upper plate from a first end of the arm to a second end of the arm, an end surface of each arm extending between an upper surface of the arm and a lower surface of the arm and between a front surface of the arm and a rear surface of the arm and being exposed to an exterior of the article of footwear.

2. The article of footwear of claim 1, wherein the upper plate extends along substantially an entire length of the sole assembly.

3. The article of footwear of claim 1, wherein the sole assembly includes a plurality of lateral lower plate arms and a plurality of medial lower plate arms.

4. The article of footwear of claim 3, wherein the lower plate includes:

a first lateral lower plate arm positioned in a front portion of the forefoot of the sole assembly;

a second lateral lower plate arm positioned in a central portion of the forefoot of the sole assembly;

a third lateral lower plate arm positioned in a rear portion of the forefoot of the sole assembly;

a first medial lower plate arm positioned in a front portion of the forefoot of the sole assembly;

a second medial lower plate arm positioned in a rear portion of the forefoot of the sole assembly; and a third medial lower plate arm positioned in a rear portion of the forefoot of the sole assembly.

5. The article of footwear of claim 1, wherein the sole assembly further comprises:

a midsole, an upper surface of the midsole secured to a lower surface of the upper and a lower surface of the midsole secured to an upper surface of the upper plate; and an outsole secured to a lower surface of the lower plate.

6. The article of footwear of claim 1, wherein the upper plate extends around a heel portion of the sole assembly.

7. The article of footwear of claim 1, wherein the lower plate arms extend around a heel portion of the sole assembly.

8. An article of footwear comprising, in combination:

an upper; and a sole assembly secured to the upper and comprising:

an upper plate having a medial side curving upwardly along a portion of the upper and a lateral side curving upwardly along a portion of the upper; and a lower plate having a plurality of lower plate arms curving downwardly from a lateral side of a forefoot portion of the upper plate and a plurality of lower plate arms curving downwardly from a medial side of a forefoot portion of the upper plate, each lower plate arm curving downwardly from a first end of the arm to a second end of the arm, an end surface of each arm extending between an upper surface of the arm and a lower surface of the arm and between a front surface of the arm and a rear surface of the arm and being exposed to an exterior of the article of footwear.

9. The article of footwear of claim 8, wherein the upper plate extends along substantially an entire length of the sole assembly.

10. The article of footwear of claim 8, wherein the upper plate extends around a heel portion of the sole assembly.

11. The article of footwear of claim 8, wherein the lower plate arms extend around a heel portion of the sole assembly.

12. An article of footwear comprising, in combination:

an upper;

a midsole positioned beneath the upper;

a plate assembly having:

a plurality of upper plate arms curving upwardly along substantially an entire length of a medial side and a lateral side of the midsole; and a plurality of lower plate arms, each lower plate arm curving downwardly from a first end of the arm to a second end of the arm, an end surface of each lower plate arm extending between an upper surface of the arm and a lower surface of the arm and between a front surface of the arm and a rear surface of the arm and being exposed to an exterior of the article of footwear, a first set of the lower plate arms extending along substantially an entire length of a medial side of the midsole and a second set of the lower plate arms extending along substantially an entire length of a lateral side of the midsole; and an outsole positioned beneath the plate assembly.

13. The article of footwear of claim 12, wherein the upper plate arms extend around a heel portion of the midsole.

14. The article of footwear of claim 13, wherein the lower plate arms extend around a heel portion of the midsole.

* * * * *